US007823706B2

(12) United States Patent
Tyni et al.

(10) Patent No.: US 7,823,706 B2
(45) Date of Patent: Nov. 2, 2010

(54) CONDITION MONITORING SYSTEM

(75) Inventors: Tapio Tyni, Hyvinkää (FI); Pekka Perälä, Kerava (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/902,354

(22) Filed: Sep. 20, 2007

(65) Prior Publication Data

US 2008/0230326 A1 Sep. 25, 2008

Related U.S. Application Data

(63) Continuation of application No. PCT/FI2006/000106, filed on Apr. 7, 2006.

(30) Foreign Application Priority Data

Apr. 8, 2005 (FI) ..... 20050361
Mar. 24, 2006 (FI) ..... 20060277

(51) Int. Cl.
*B66B 3/00* (2006.01)

(52) U.S. Cl. ..... 187/393; 187/391

(58) Field of Classification Search ..... 187/391, 187/393

See application file for complete search history.

(56) References Cited

U.S. PATENT DOCUMENTS 4,512,442 A * 4/1985 Moore et al. ..... 187/393
5,064,026 A * 11/1991 Nagata et al. ..... 187/391
5,476,157 A * 12/1995 Todaro ..... 187/280
5,522,480 A 6/1996 Hofmann
5,616,895 A 4/1997 Spiess et al.
5,760,350 A * 6/1998 Pepin et al. ..... 187/316
5,817,993 A * 10/1998 Kamani et al. ..... 187/316
6,102,163 A 8/2000 Liebetrau et al.
6,173,814 B1 * 1/2001 Herkel et al. ..... 187/288
6,364,066 B1 * 4/2002 Bolch et al. ..... 187/391
6,467,585 B1 * 10/2002 Gozzo et al. ..... 187/391
7,264,090 B2 * 9/2007 Vecchiotti et al. ..... 187/391
2002/0117358 A1 * 8/2002 Schoppa et al. ..... 187/391
2003/0217894 A1 * 11/2003 Perala et al. ..... 187/316
2004/0009436 A1 1/2004 Lee et al.
2004/0020658 A1 2/2004 Kulhanek et al.
2005/0098390 A1 * 5/2005 Angst ..... 187/391

FOREIGN PATENT DOCUMENTS

DE 101 50 284 A1 4/2003
EP 0 839 750 A2 5/1998

(Continued)

*Primary Examiner*—Walter Benson
*Assistant Examiner*—Kawing Chan
(74) *Attorney, Agent, or Firm*—Birch, Stewart, Kolasch & Birch, LLP

(57) ABSTRACT

The present invention relates to an elevator condition monitoring system, which comprises at least a control unit (104) and a sensor arrangement (250) connected to the control unit, while the elevator comprises an elevator car (100), an elevator drive machine (109) and a control system (110) including the required safety circuit and actuators. The control unit of the condition monitoring system and the sensor arrangement connected to the control unit have been fitted in conjunction with the elevator car. The sensor arrangement comprises at least a sensor which measures the current of the safety circuit and is galvanically separated from the elevator safety circuit and connected to the safety circuit without interrupting the safety circuit wiring.

10 Claims, 3 Drawing Sheets

FOREIGN PATENT DOCUMENTS

Figure 1:
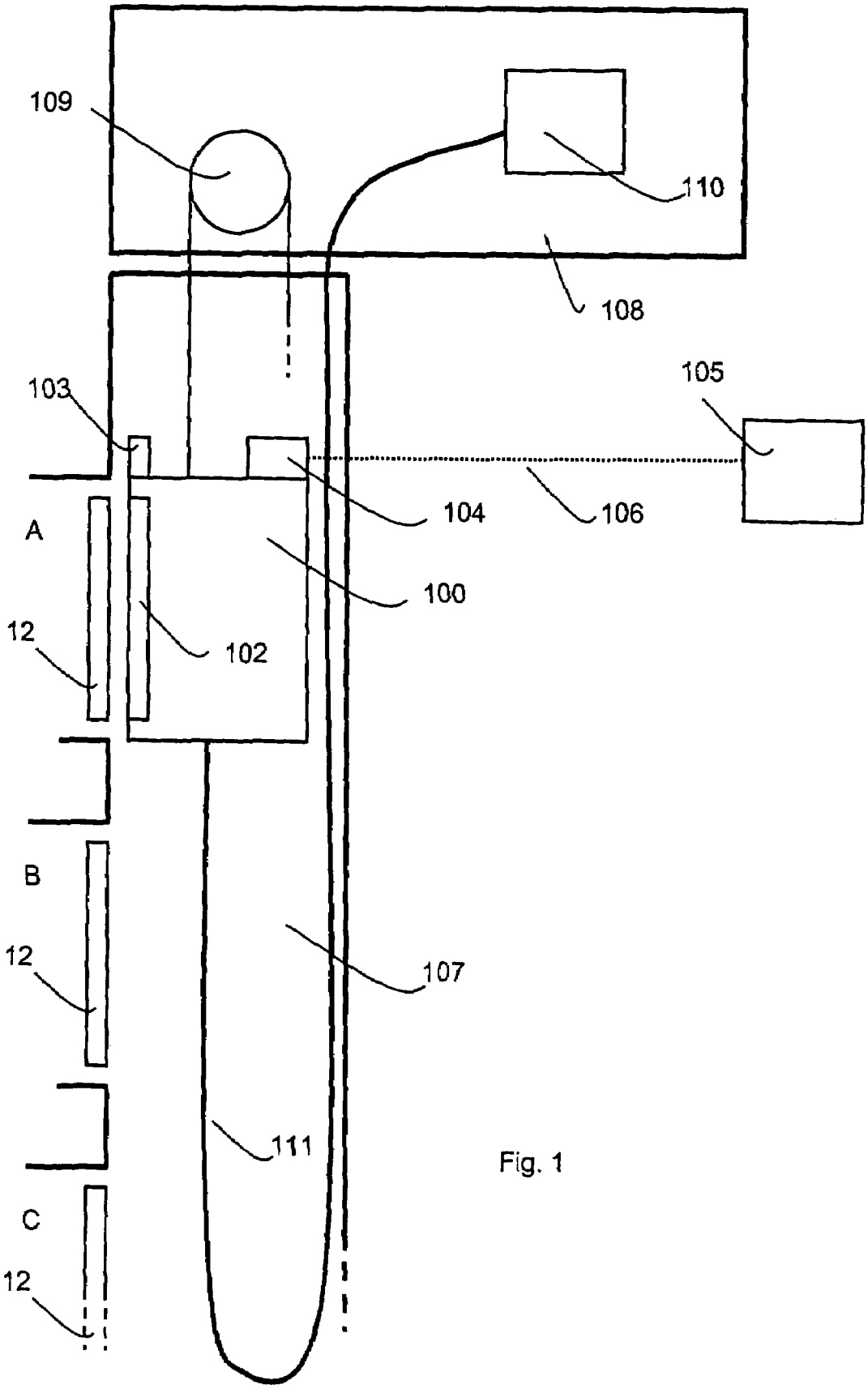

| | | | |
|---|---|---|---|
| FI | 20041241 | A | 3/2006 |
| WO | WO-92/08665 | A1 | 5/1992 |
| WO | WO 9316949 | A1 * | 9/1993 |
| WO | WO-99/43587 | | 9/1999 |
| WO | WO-01/14237 | A1 | 3/2001 |

* cited by examiner

CONDITION MONITORING SYSTEM

This application is a Continuation of copending PCT International Application No. PCT/FI2006/000106 filed on Apr. 7, 2006, which designated the United States, and on which priority is claimed under 35 U.S.C. §120. This application also claims priority under 35 U.S.C. §119(a) on Patent Application No(s). 20050361 filed in Finland on Apr. 8, 2005 and 20060277 filed in Finland on Mar. 24, 2006. The entire contents of each of the above documents is hereby incorporated by reference.

The present invention relates to elevator systems. In particular, the present invention relates to a system for monitoring the operational condition of elevators.

BACKGROUND OF THE INVENTION

An elevator system is an electromechanical assembly of equipment that contains many movable and rotating parts, which are subjected to wear and failures during the operation of the elevator system. Also, the actuators controlling the movable and rotating parts as well as the electric components and sensors connected to the said actuators are subjected to wear and failures in long-time operation of the elevator system. A failure may also be caused by unexpected external factors, such as e.g. a violent impact against the elevator door or as a result of vandalism perpetrated on the elevator. However, it is of primary importance for the operation of elevator systems that the elevator system should work correctly and above all safely in all operational conditions. Therefore, elevator systems are serviced regularly to guarantee safe operation and sufficient riding comfort. If the elevator is not serviced in time, the elevator may fail so that either passengers can not use the elevator at all or the quality of operation of the elevator deteriorates significantly. Before an actual failure, the elevator may become noisy, there may appear unpleasant vibrations of the elevator car, the stopping accuracy of the elevator car at landings may deteriorate or some other corresponding feature of the operation of the elevator may be impaired, indicating a future failure in advance. The scheduling of maintenance of elevators has traditionally been implemented either via regular maintenance according to a fixed calendar-based schedule and/or on the basis of the intensity of operation (operating history) of the elevator. The intensity of operation again depends on the place of installation of the elevator, causing individual needs regarding maintenance arrangements. If a need for maintenance is not detected until one of the actuators controlling the operation of the elevator suddenly fails and prevents preparation of the elevator, this may result in a service advice made by the client, causing extra expenses to the party responsible for the operation of the elevator. One method of eliminating or at least reducing the number of unscheduled maintenance visits is to provide the elevator with a condition monitoring system. The function of a condition monitoring system is to observe the operation of the elevator and to generate parameters representing its operational condition, on the basis of which it is possible to estimate the current operational condition of the elevator and to predict its future operational condition to enable mapping of the need for preventive maintenance. The condition monitoring system generally connects to signals indicative of the operation of the elevator, on the basis of which the system calculates parameters descriptive of the operational condition of the elevator. A sufficiently large deviation or trend of change of a parameter in relation to defined reference values produces a particular alarm about an acute or anticipated failure. The alarm information is often transmitted from the condition monitoring system to a maintenance center responsible for the maintenance of the elevator system, where the decisions regarding the required maintenance operations and their scheduling are made. For example, the systems disclosed in U.S. Pat. No. 4,512,442 Moore et al. keep count of how many times the doors have been opened and closed and send the count to a maintenance center for maintenance scheduling. Scheduling based on intensity of operation can be made more accurate by taking the type of the building into account. Certain more advanced prior-art systems additionally use operating history data of elevators for condition monitoring.

Prior-art condition monitoring systems have considerable drawbacks and deficiencies. The signals indicative of the operation of the elevator are often difficult to obtain, which is why installing and connecting the condition monitoring system to the elevator system is difficult and time-consuming. Some of the signals needed in condition monitoring may be located at a long distance from each other, for example in a control panel in the elevator machine room while some other signals are located in the elevator car. In this case it is necessary to have an extra car cable between the elevator car and the machine room to provide the wiring for the required signals to the condition monitoring system, involving a sharp increase in installation costs and time. In prior-art solutions, making a connection to the signals to be measured generally requires a galvanic connection between the condition monitoring system and the elevator control system, and often also changes in the cabling of the elevator, causing unnecessary installation work and extra costs. The galvanic connection method involves the risk of causing interference with the operation of the elevator system signals used for condition monitoring, thus producing a safety hazard. For this reason, an elevator often has to be subjected for approval by authorities supervising elevator safety to check the operation of the safety equipment after the installation of a condition monitoring system.

A further problem with prior-art solutions is that elevator systems differ significantly from each other in both electrical and functional respects. The condition monitoring system has to take into account, among other things, the current and voltage levels of the signals used in the elevator to be monitored, the timing of the signals and other elevator-specific circumstances. Condition monitoring systems implemented according to prior-art technology are therefore generally applicable only in connection with certain elevator types, but installing them in old elevators may be impossible or the required installation, modification and configuration work may become a significant cost factor.

OBJECT OF THE INVENTION

The object of the present invention is to overcome some of the above-described drawbacks and deficiencies encountered in prior-art solutions and to achieve a completely new type of solution for monitoring the condition of an elevator. An additional object of the invention is to achieve one or more of the following aims:

- a condition monitoring system that can be easily and quickly installed both on new elevators and on existing elevators,
- installation without an extra car cable,
- automatic determination of threshold values and setting parameters in conjunction with a test run and/or operation of the elevator,
- to reduce vandalism, to improve traveling safety,
- to improve riding comfort, to store data about the elevator system for later use e.g. in the preparation of trend analyses to provide more accurate information on the operational condition.

BRIEF DESCRIPTION OF THE INVENTION

The condition monitoring system of the invention is characterized by what is disclosed in the characterization part of claim 1. Other embodiments of the invention are characterized by what is disclosed in the other claims. Inventive embodiments are also presented in the description part and drawings of the present application. The inventive content disclosed in the application can also be defined in other ways than is done in the claims below. The inventive content may also consist of several separate inventions, especially if the invention is considered in the light of explicit or implicit sub-tasks or in respect of advantages or sets of advantages achieved. In this case, some of the attributes contained in the claims below may be superfluous from the point of view of separate inventive concepts. Within the framework of the basic concept of the invention, features of different embodiments of the invention can be applied in conjunction with other embodiments.

Below are definitions of the meaning of some terms used in the text:

- maintenance need: defines the actions and their urgency for the reparation of detected faults and/or deficiencies in quality,
- elevator operation data: contains information about the use of the elevator, trips made on the elevator and/or other corresponding circumstances associated with the operation of the elevator within a known period of time,
- elevator drive machine: comprises the equipment needed for moving the elevator car in the elevator shaft. The equipment comprises a drive motor, a set of hoisting ropes, a motor brake or brakes to prevent motion of the car, the guide rails and guide shoes for guiding the elevator car in the elevator shaft,
- threshold values and setting parameters: this term refers to all those parameters, settings, tolerance values and measurement reference values which are determined on the basis of the individual installation or some other corresponding ground and which can be configured in the condition monitoring system. Threshold values and setting parameters are used for the observation of changes in derived and/or result quantities to detect failure situations and/or a need for preventive maintenance.

The invention concerns an elevator condition monitoring system which comprises at least a control unit and a sensor arrangement connected to the control unit. The elevator comprises an elevator car, an elevator drive machine and a control system, including the required safety circuit and actuators. According to the invention, the control unit of the condition monitoring system and the sensor arrangement connected to the control unit are fitted in conjunction with the elevator car, and the said sensor arrangement comprises at least a sensor measuring the current of the elevator safety circuit, said sensor being galvanically separated from the elevator safety circuit and connected to the safety circuit without interrupting the safety circuit wiring. The control unit and the sensor arrangement are preferably fitted on the top of the elevator car.

In an embodiment of the invention, in addition to the sensor measuring the safety circuit current, the sensor arrangement connected to the control system comprises one or more of the following sensors:

- an acceleration sensor as a means of measuring car door acceleration,
- a current sensor as a means of measuring the current of the door operator motor,
- an acceleration sensor as a means of measuring elevator car acceleration,
- a microphone as a means of measuring elevator door noise and/or elevator traveling noise,
- a current sensor as a means of measuring the current of elevator car illumination,
- a proximity sensor as a detector of a door zone and the edge of a door zone, and
- a temperature sensor as a means of measuring the temperature of the elevator car and/or elevator shaft one or more of the aforesaid sensors being galvanically separated from the elevator control system.

In an embodiment of the invention, the condition monitoring system produces one or more of the following derived quantities:

- door noise components during door operation,
- traveling noise components when the elevator is moving between floors,
- door motion components during door operation,
- door status data,
- door motor current components during door operation,
- elevator car motion components when the elevator is moving between floors,
- elevator car status data,
- safety circuit status data,
- stopping accuracy of the elevator car at a landing, and
- current components of car illumination.

In an embodiment of the invention, utilizing derived quantities, the condition monitoring system determines one or more result quantities, which indicate:

- operational condition of car illumination, and/or
- operational condition of the door mechanism, and/or
- operational condition of the elevator drive machine, and/or
- operational condition of the safety circuit, and/or
- performance of the elevator, and/or
- operating history of the elevator.

In an embodiment of the invention, the condition monitoring system comprises a memory device for the storage of derived quantities and/or result quantities for later use.

In an embodiment of the invention, the condition monitoring system comprises a data transfer connection for the transmission of derived quantities and/or result quantities and/or alarms indicative of the operational condition of the elevator to a remote monitoring system.

In an embodiment of the invention, the condition monitoring system has been fitted to send information stored on the memory device to the remote monitoring system at predetermined points of time.

In an embodiment of the invention, the condition monitoring system comprises a memory device with one or more derived quantity threshold values stored on it for the detection of failure situations and/or a need for preventive maintenance.

In an embodiment of the invention, one or more threshold values and/or setting parameters have been determined by performing at least one test run of the elevator.

In an embodiment of the invention, the condition monitoring system has been fitted to determine threshold values and/or setting parameters on the basis of statistical and/or other corresponding analyses.

The condition monitoring system of the present invention has several advantages as compared to prior-art solutions. The condition monitoring system is easy and quick to install, because its control unit and the sensors connected to it are placed in conjunction with the elevator car. To connect the sensors, no extra car cable is needed between the elevator car and the elevator control system. The sensors required in condition monitoring are also easy to install as retrofits in conjunction with the elevator car because their placement in conjunction with the elevator car is nearly freely selectable and the existing cabling of the elevator car need not necessarily be modified. As it uses sensors galvanically separated from the control unit of the elevator system, the system of the invention causes no safety risk in the operation of the elevator system. Especially making a connection to the safety circuit of the elevator system involves no problems because the connection does not form a galvanic connection between the condition monitoring system and the elevator safety circuit and it does not require interruption of the safety circuit (e.g. disconnection of a safety circuit conductor from a connector), and therefore also extra inspections by authorities after installation of the system are avoided. To allow faster installation, configuration of the system can be executed automatically. Using the system of the invention, it is also possible to collect information about the use of the elevator system and to measure the performance of the elevator system. The data produced by the system can be transferred to a remote maintenance system for the preparation of statistical and other corresponding analyses concerning e.g. the operational condition, use and/or performance of the elevator system.

LIST OF FIGURES

Figure 2:
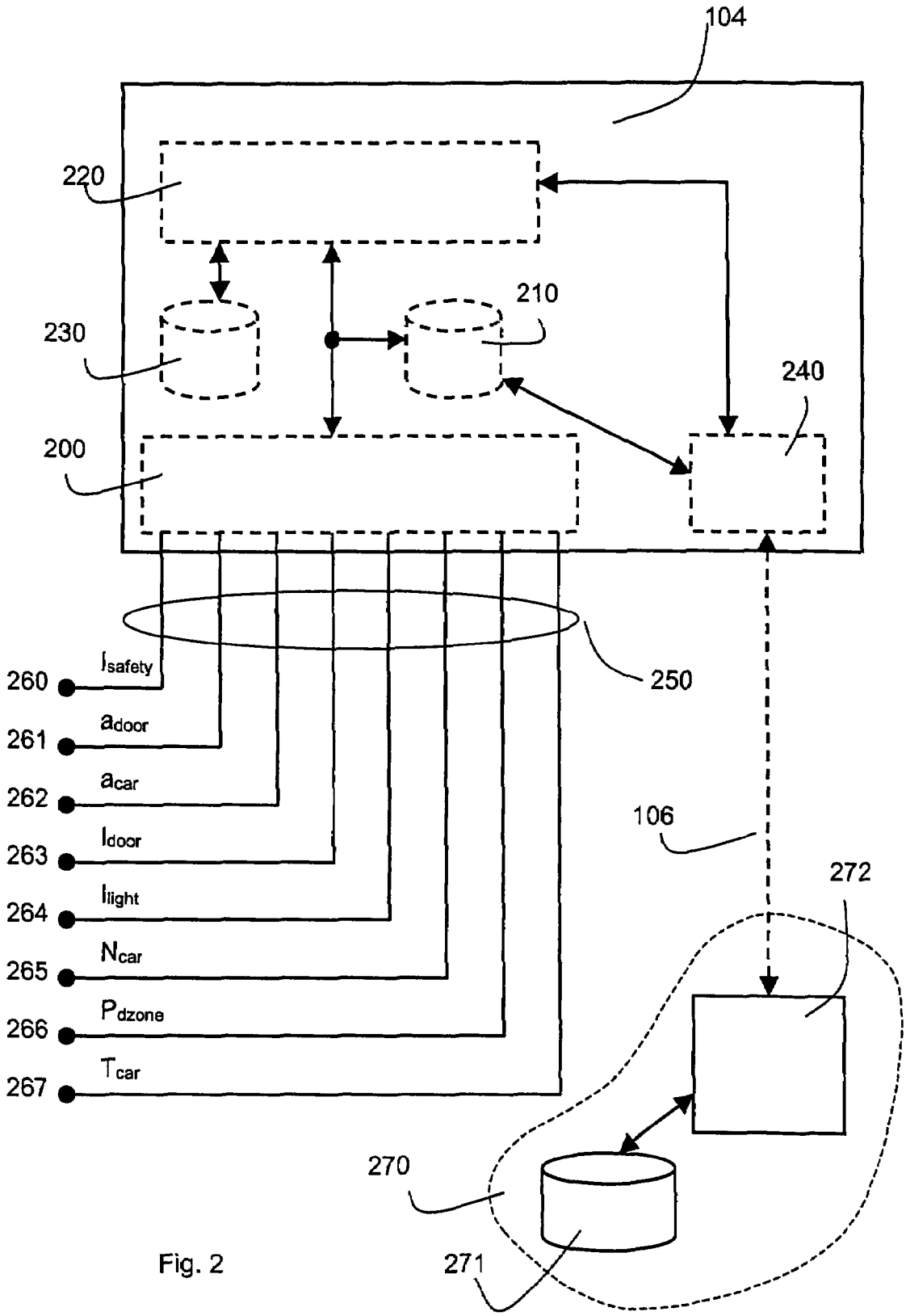
Figure 3:
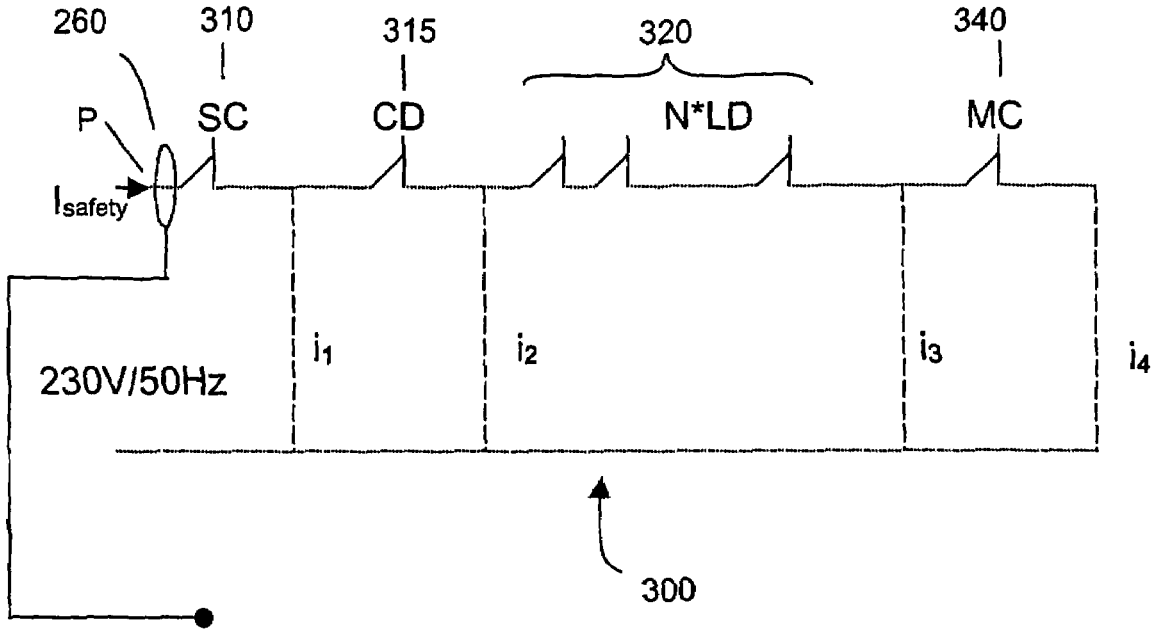

FIG. 1 presents an arrangement according to the invention in an elevator system, FIG. 2 presents a block diagram of the system of the invention, and FIG. 3 presents an elevator safety circuit connection.

DETAILED DESCRIPTION OF THE INVENTION

FIG. 1 presents by way of example an arrangement according to the invention in an elevator system. Reference number 100 indicates an elevator car, which comprises a car door 102 and a door operator 103 controlling the opening and closing of the car door 102. Placed on the top of the elevator car is the control unit 104 of the condition monitoring system, which, via a sensor arrangement (not shown in FIG. 1) mounted in conjunction with the car, measures and analyzes signals indicative of the operational condition of the elevator. The elevator car is moved in an elevator shaft 107 between floors A, B, C by a drive machine 109. Each floor level is provided with a landing door 12, which is opened and closed together with the car door when the elevator car is at the landing in question. The elevator control system 110 is placed in the machine room 108, from where the control system communicates with the elevator car via a car cable 111 to transmit the required control signals and electric power between the elevator car and the elevator control system. The elevator control system also comprises a number of actuators, such as e.g. elevator call panels and display units and cables (not shown in FIG. 1) connecting these.

FIG. 2 presents a block diagram, by way of example, of the condition monitoring system of the invention. The control unit 104 of the condition monitoring system is e.g. a computer unit provided with a processor, a memory and the required interfaces and software. The control unit contains a signal receiving and processing unit 200, where the signals 250 measured from the elevator system are received and processed to produce derived quantities. Derived quantities in this context refers to quantities derived from the measured signals 250 for use in the monitoring of the operational condition of the elevator, such as e.g. the effective value, frequency spectrum, divergence or mean value of the signal or some other corresponding quantity reflecting the behavior of the signal, and to status data of the system or actuator to be monitored that can be determined on the basis of the measured signal. The derived quantities produced are transmitted to an analyzing unit 220. At least some of the derived quantities produced are stored on a memory device 210 for later utilization. The function of the analyzing unit is to observe the operational condition of the elevator on the basis of the derived quantities produced and to generate specified alarms about detected defects and preventive maintenance needs to be communicated to the remote monitoring system 272 of a maintenance center 270. For estimation of the operational condition, the memory device 230 of the analyzing unit contains a number of threshold values and setting parameters, and if the signal remains below or exceeds the threshold value or setting parameter, an alarm regarding a fault or preventive maintenance need is generated. The aforesaid threshold values and other required setting parameters are determined in connection with the commissioning of the elevator system e.g. by performing one or more test runs of the elevator, or the threshold values are formed during normal operation from the statistical properties of the quantities and derived quantities. Reference number 240 indicates a data transfer means for forming a data transfer connection 280 between the control unit 104 and the remote supervision system 272. The data transfer connection may be any data transfer connection applicable for the purpose, preferably a wireless data transfer connection.

In FIG. 2, reference number 260 indicates a current sensor used to measure the current $I_{safety}$ flowing in the elevator safety circuit. The safety circuit of the elevator typically consists of safety contacts and switches connected in series as in the circuit 300 presented in FIG. 3. SC 310 represents the static circuit of the safety circuit, whereas switch CD 315 represents the car door switch and switches N*LD 320 the landing door switches. N is the number of floor levels, depending on how many floors the elevator comprises. Switch MC 340 corresponds to the main contactor of the elevator. The total current $I_{safety}$ of the safety circuit is determined by the states of the switches SC, CD, LD and MC and the corresponding partial currents i1, i2, i3, i4. Thus, the condition monitoring system is able to infer the state of the safety circuit at each instant on the basis of the total current $I_{safety}$. Table 1 below contains definitions of the possible states of the safety circuit as presented in FIG. 3:

TABLE 1

| Safety circuit current at point P | State of switches | Functional state of safety circuit |
|---|---|---|
| i = 0 | SC = 0, CD = LD = not visible, MC = 0 | static circuit is open, door status is not visible, main contactor is de-energized |
| i = i1 | SC = 1, CD = 0, LD = not visible, MC = 0 | static circuit is closed, car door is open, landing door is not visible, main contactor is de-energized |
| i = i1 + i2 | SC = 1, CD = 1, LD = 0, MC = 0 | static circuit is closed, car door is closed, landing door is open, main contactor is de-energized |
| i = i1 + i2 + i3 | SC = 1, CD = 1, LD = 1, MC = 0 | static circuit is closed, car and landing doors are closed, main contactor is de-energized |
| i = i1 + i2 + i3 + i4 | SC = 1, CD = 1, LD = 1, MC = 1 | static circuit is closed, car and landing |

TABLE 1-continued

| Safety circuit current at point P | State of switches | Functional state of safety circuit |
|---|---|---|
| | | doors are closed, main contactor is energized |

By determining the states of the safety circuit in the above-described manner in different operating situations of the elevator, the condition monitoring system is able to determine the operational condition of the elevator safety circuit and of the actuators influencing the state of the safety circuit.

The car door, the landing doors and the door operator mounted on the car form a door mechanism, the condition of which is monitored by means of an acceleration sensor attached to a car door leaf to measure the acceleration $a_{door}$ of the horizontal motion of the door leaf. To obtain a more accurate determination of the operational condition of the door mechanism, it is also possible to measure door leaf accelerations perpendicular to the aforesaid motion. The acceleration $a_{door}$ is used as a means of observing the motion components of the door leaf during a door operation, such as e.g. instantaneous acceleration, speed, position and/or vibration spectrum of the door leaf. From the door leaf motion components, it is further possible to infer door status data (states and their mutual timing). Possible door states are: closed, opening, opened, closing, reopening, nudging. In the solution illustrated in FIG. 2, the door operator current $I_{door}$ is also measured by a current sensor 263. The motor current indicates the motor torque and therefore the forces, such as friction, resisting the opening and closing motion of the door. Changes in the door motion components and/or in the current of the door operator motor and/or in the status data indicate wear or soiling of the door mechanism and/or an electrical or mechanical fault. The condition of the door mechanism can also be monitored by means of a microphone 264 mounted on the elevator car by analyzing the frequency spectrum of the noise $N_{car}$ produced during door operations. An increase in the amplitude of the noise at the frequencies considered indicates changes occurring in the door mechanism, such as e.g. wear.

For monitoring of the condition of the elevator drive machine, the elevator is provided with an acceleration sensor 62 mounted on the car to measure the vertical acceleration $a_{car}$ of the elevator car. To obtain a more accurate determination of the operational condition, it is also possible to measure car accelerations perpendicular to the vertical motion. Vertical motion components of the elevator car, such as e.g. instantaneous acceleration, speed, location in the elevator shaft and/or vibration spectrum, are calculated from the acceleration $a_{car}$ by known mathematical methods. From the car motion components, it is further possible to infer car status data. The car status may be one of the following: standing, accelerating, constant speed, decelerating, creeping, releveling. Changes in the motion components and/or status data of the elevator car indicate wear, soiling and/or an electrical or mechanical fault of the drive machine. The condition of the drive machine can also be monitored by means of a microphone 264 mounted on the elevator car by analyzing the frequency spectrum of the noise $N_{car}$ produced during the various stages of operation of the elevator. An increase in the amplitude of the noise at the frequencies considered indicates changes, such as e.g. wear, taking place in the drive machine.

The condition of the drive machine can also be monitored by means of a door zone sensor 266 mounted on the elevator car. The sensor detects the entry and exit of a reference mounted at each floor level into/from the detection field of the sensor as the elevator is moving in the elevator shaft. By combining the door zone reference detection data $P_{dzone}$ and the location data derived from the acceleration $a_{car}$ of the elevator car, it is possible to determine the exact stopping distance of the elevator car relative to the edge of the reference detected and thus to monitor the stopping accuracy of the elevator car at different landings. Variation in the stopping accuracy of the car indicates changes in the elevator drive machine, such as e.g. in the brake of the drive machine.

In FIG. 2, reference number 267 indicates a temperature sensor which is used to measure the internal and/or external temperature $T_{car}$ of the elevator car. When the temperature changes, the values of the quantities indicative of the operation of the drive machine may change e.g. as a result of a change in the viscosity of the lubricants of the drive machine. By taking into account the temperature $T_{car}$ prevailing in the elevator car and/or elevator shaft, it is possible to compensate the changes in question and thus to improve the accuracy of the quantities indicative of the operational condition of the elevator. The temperature measurement can also be used for monitoring the operational condition of a possible air conditioning system of the elevator car and/or for the detection of fires started in the building.

To monitor the illumination of the elevator car, the condition monitoring system measures the current $I_{light}$ consumed by the lighting by means of a current sensor 264. When the lighting current is reduced in relation to the reference value of the current, it is possible to infer the number of defective light sources. If the current becomes pulsating, this indicates a future failure of a light source.

Besides the above-described data associated with condition monitoring of the elevator, the system also produces information relating to the use and performance of the elevator. Utilizing the measured signals and the status data derived from the signals, it is possible to determine the times of activity of the various actuators comprised in the elevator as well as the numbers of actions, such as e.g. the number of door operations, duration of the stages of door operations, the number of departures and stops of the elevator at each floor, traveling times of the elevator between different floors. Thus, the system can produce information for the calculation of the performance and operating history of the elevator.

The data collected on the memory device 210 is transferred from the control unit to the remote monitoring system 105 over the data transfer connection 106 in periods of defined time intervals. The data received in the remote monitoring system is stored in a database 271, where the data can be further used for statistical analyses, calculation of operating intensity of the elevator (operating history of the elevator) and/or performance of the elevator.

The sensor arrangement 250 consists of a number of sensors, one or more of which are galvanically separated from the elevator control system. The elevator car has to be retrofitted with sensors unless it is already provided with sensors ready for connection to the remote monitoring system. 'Sensor' also refers to measuring points (e.g. connectors) which already exist in conjunction with the elevator car and to which the condition monitoring system can be connected directly by conductors. In such cases, the sensor producing the signal to be measured may also be located elsewhere in the elevator system than on the elevator car, where the sensor signal has already been wired as an implementation comprised in the elevator system. The current sensors used for the current measurement are e.g. ferrite core sensors based on induction, the core structure of which can be opened so as to allow threading of the current conductor to be monitored into the passage formed by the sensor core without breaking the conductor. In conjunction with these sensors it is advantageous to compensate the frequency response and/or temperature creep of the sensor by using a suitable compensating connection to improve measured acceleration ad the measuring accuracy. For detection of the door zone reference, the elevator car is provided with an proximity sensor 266, which may be any contactless proximity sensor suited for the purpose, such as e.g. an inductive, optical or capacitive proximity sensor. The proximity sensor identifies the reference mounted at each landing, e.g. bar-like object made of magnetic material or a luminescent elongated sticker.

To determine the threshold values and setting parameters used by the condition monitoring system, one or more test runs are performed on the elevator after the installation of the system. Based on the information collected during the test runs, the condition monitoring system determines at least some of the threshold values and/or setting parameter values automatically. During operation of the elevator system, the condition monitoring system collects data about the elevator system and updates the aforesaid values by known statistical methods. Thus, the condition monitoring system is self-learning and is able to automatically adapt itself to changing conditions.

In the case of an elevator system with a multi-deck elevator, wherein two or more elevator cars have been fitted in the same car frame, one or more condition monitoring systems are installed to monitor the operational condition of the elevator in question.

It is obvious to the person skilled in the art that the invention is not limited to the embodiments described above, in which the invention has been described by way of example, but that different embodiments of the invention are possible within the scope of the inventive concept defined in the claims presented below.

The invention claimed is:

1. A system for condition monitoring of an elevator, said system comprising:

at least a control unit and a number of sensors of a sensor arrangement for condition monitoring connected to the control unit, and said elevator comprising an elevator car, an elevator drive machine and an elevator control system including required safety circuit and actuators, the safety circuit including one or more contacts and switches wherein the control unit and the sensor arrangement connected to the control unit have been directly located on the elevator car and that the sensors of the sensor arrangement are galvanically separated from the elevator control system and from the elevator safety circuit such that the safety circuit is a closed system separate from said control unit and sensor arrangement; and wherein at least one sensor of the sensor arrangement is connected to the safety circuit without interrupting the safety circuit wiring so as to obtain information pertaining to a current flowing in said safety circuit.

2. A system according to claim 1, wherein, in addition to the safety circuit sensor 260, the sensor arrangement comprises one or more of the following sensors:

an acceleration sensor as a means of measuring the acceleration of the door, a current sensor as a means of measuring the current of the motor of the door operator, an acceleration sensor as a means of measuring the acceleration of the elevator car, a microphone as a means of measuring the door noise of the elevator or the traveling noise of the elevator, a current sensor as a means of measuring the current of elevator car illumination, a proximity sensor as a detector of a door zone and the edge of a door zone, and a temperature sensor as a means of measuring the temperature of the elevator car or elevator shaft.

3. A system according to claim 1, wherein the system produces one or more of the following derived quantities:

door noise components during a door operation, traveling noise components when the elevator is moving between floors, door motion components during a door operation, door status data, door motor current components during a door operation, elevator car motion components when the elevator is moving between floors, elevator car status data, safety circuit status data, stopping accuracy of the elevator car at a landing, and current components of car illumination.

4. A system according to claim 1, wherein, utilizing the derived quantities, the system calculates one or more result quantities, which indicate one or more of:

operational condition of car illumination, operational condition of the door mechanism, operational condition of the elevator drive machine, operational condition of the safety circuit of the elevator, performance of the elevator, and operating history of the elevator.

5. A system according to claim 1, wherein the system further comprises a memory device for the storage of derived quantities or result quantities for later use.

6. A system according to claim 1, wherein the system further comprises a data transfer connection for the transmission of derived quantities or result quantities or alarms indicative of the operational condition of the elevator to a remote monitoring system.

7. A system according to claim 6, wherein the condition monitoring system has been fitted to send information stored on a memory device to the remote monitoring system at predetermined points of time.

8. A system according to claim 1, wherein the system further comprises a memory device, on which are stored one or more threshold values or setting parameters for the detection of failure situations or a need for preventive maintenance.

9. A system according to claim 1, wherein one or more threshold values or setting parameters have been determined by performing at least one test run of the elevator.

10. A system according to claim 1, wherein the system has been fitted to determine threshold values or setting parameters on the basis of statistical or other corresponding analyses.

* * * * *